US009108439B2

(12) United States Patent
Toda et al.

(10) Patent No.: US 9,108,439 B2
(45) Date of Patent: Aug. 18, 2015

(54) METHOD OF FORMING IMAGE AND INK JET RECORDING APPARATUS

(71) Applicants: Naohiro Toda, Kanagawa (JP); Hidefumi Nagashima, Kanagawa (JP); Tomohiro Nakagawa, Kanagawa (JP)

(72) Inventors: Naohiro Toda, Kanagawa (JP); Hidefumi Nagashima, Kanagawa (JP); Tomohiro Nakagawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/203,732

(22) Filed: Mar. 11, 2014

(65) Prior Publication Data

US 2014/0267520 A1 Sep. 18, 2014

(30) Foreign Application Priority Data

Mar. 13, 2013 (JP) ..... 2013-049899
Feb. 19, 2014 (JP) ..... 2014-029109

(51) Int. Cl.
*B41J 2/01* (2006.01)
*B41J 11/00* (2006.01)
*B41M 5/00* (2006.01)

(52) U.S. Cl.
CPC ..... *B41J 11/002* (2013.01); *B41M 5/0011* (2013.01); *B41M 5/0047* (2013.01); *B41M 5/0064* (2013.01)

(58) Field of Classification Search
CPC ..... B41M 1/26–1/38
USPC ..... 347/102
See application file for complete search history.

(56) References Cited

U.S. PATENT DOCUMENTS

| | | | | |
|---|---|---|---|---|
| 2007/0046748 | A1* | 3/2007 | Sano et al. | 347/100 |
| 2007/0197685 | A1* | 8/2007 | Aruga et al. | 523/160 |
| 2009/0258196 | A1 | 10/2009 | Nagashima et al. | |
| 2009/0284762 | A1* | 11/2009 | Zhang et al. | 358/1.9 |
| 2010/0196673 | A1 | 8/2010 | Nagashima et al. | |
| 2011/0164086 | A1 | 7/2011 | Ggoto et al. | |
| 2011/0205288 | A1 | 8/2011 | Matsuyama et al. | |
| 2011/0242200 | A1* | 10/2011 | Tojo et al. | 347/21 |
| 2011/0318551 | A1 | 12/2011 | Nakagawa | |
| 2012/0188312 | A1 | 7/2012 | Nakagawa | |
| 2012/0308785 | A1 | 12/2012 | Nakagawa | |
| 2013/0002776 | A1 | 1/2013 | Nagashima et al. | |
| 2013/0063524 | A1 | 3/2013 | Katoh et al. | |
| 2013/0143008 | A1 | 6/2013 | Gotou et al. | |
| 2013/0197144 | A1 | 8/2013 | Keita Katoh et al. | |
| 2013/0271524 | A1 | 10/2013 | Katoh et al. | |

FOREIGN PATENT DOCUMENTS

| | | |
|---|---|---|
| JP | 2005-220352 | 8/2005 |
| JP | 2011-088323 | 5/2011 |
| JP | 2012-040778 | 3/2012 |

* cited by examiner

*Primary Examiner* — Jannelle M Lebron
*Assistant Examiner* — Jeremy Bishop
(74) *Attorney, Agent, or Firm* — Cooper & Dunham LLP

(57) ABSTRACT

A method of forming an image includes a step of heating a nonporous substrate to a temperature in a range of from 30° C. to 80° C.; and a step of forming an image on the nonporous substrate by applying water-based inks of at least two colors to the nonporous substrate employing an ink jet technique, wherein an ink set that contains water-based inks each containing a coloring material, an emulsion resin, water, and a water-soluble solvent is used to apply the water-based inks of the at least two colors, and, of the water-based inks in the ink set, at least one water-based ink has a minimum film-forming temperature different from those of water-based inks of other colors.

14 Claims, 2 Drawing Sheets

METHOD OF FORMING IMAGE AND INK JET RECORDING APPARATUS

CROSS-REFERENCE TO RELATED APPLICATIONS

This patent application is based on and claims priority pursuant to 35 U.S.C. §119 to Japanese Patent Application Nos. 2013-049899 and 2014-029109, filed on Mar. 13, 2013 and Feb. 19, 2014, respectively, in the Japan Patent Office, the entire disclosures of which are hereby incorporated by reference herein.

BACKGROUND

1. Technical Field

The present invention relates to a method of forming an image and an ink jet recording apparatus.

2. Background Art

An ink jet technique is a printing method with which fine ink droplets are sprayed onto a recording medium such as a paper sheet or a nonporous substrate to create images.

Nonporous substrates, such as polyvinyl chloride films, polyethylene terephthalate (PET) films, acrylic films, polypropylene films, polyimide films, polystyrene films, and other plastic films, tend to repel droplets of water-based inks applied by an ink jet method and it has been difficult to make water-based inks adhere to nonporous substrates. Thus, solvent inks that contain water-insoluble solvents have been typically used.

However, in recent years, there has been an increasing emphasis on environmental pollution regulations and safety of human bodies and thus there are increasing anticipations for water-based inks that can be used on impermeable media.

To address this issue, a recording method with which water-based ink droplets are adhered to a heated nonporous substrate so as to dry the ink droplets in a short time on the nonporous substrate has been employed.

However, an ink that dries fast on a nonporous substrate is likely to cause nozzle clogging as the ink dries inside the ink jet nozzles. Moreover, rapid drying on a nonporous substrate decreases the uniformity of the film, resulting in low gloss. Accordingly, a technique of enhancing the stability by adding a water-soluble solvent is being investigated so that the ink droplets applied on a heated nonporous substrate remain liquid for a very short time.

For example, JP-4520871-B1 (JP-2005-220352-A) discloses an image printing system in which an ink jet water-based ink containing, at least one volatile cosolvent having a boiling point of 285° C. or lower in a total amount of 5% to 50% by weight is used to print an image on a nonporous substrate and then the printed image is heated. According to this proposal, printing can be conducted on a nonporous substrate because the water-based ink shows an acceptable level of adhesion to the nonporous substrate.

However, according to this proposal, ink droplets come to spread on the nonporous substrate during the period from immediately after application of the ink droplets to the nonporous substrate to the time the ink is heated. This results in ink bleeding at color border portions where different colors lie adjacent to each other and it has been difficult to obtain high-quality images.

In sum, there has been neither an ink jet water-based ink set that can satisfactorily form high-gloss, high-resolution images free of bleeding on a nonporous substrate nor a satisfactory ink jet image forming technique with which an ink can be strongly fixed to a nonporous substrate and nozzle clogging is avoided even when the device is left unused for a long time.

SUMMARY

The present invention provides an improved method for forming an image including a step of heating a nonporous substrate to a temperature in a range of from 30° C. to 80° C. and a step of forming an image on the nonporous substrate by applying water-based inks of at least two colors to the nonporous substrate employing an ink jet technique, wherein an ink set that includes water-based inks each containing at least a coloring material, an emulsion resin, water, and a water-soluble solvent is used to apply the water-based inks of the at least two colors. Of the water-based inks in the ink set, at least one water-based ink has a minimum film-forming temperature different from those of water-based inks of other colors.

As another aspect of the present invention, an improved ink jet recording apparatus is provided which includes an ink set containing water-based inks of two or more colors, each water-based ink including at least a coloring material, an emulsion resin, water, and a water-soluble solvent, at least one of the water-based inks having a minimum film-forming temperature different from those of the water-based inks of other colors, a heating device to heat a nonporous substrate, and an application device to apply the water-based inks of the ink set onto the nonporous substrate to conduct recording.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
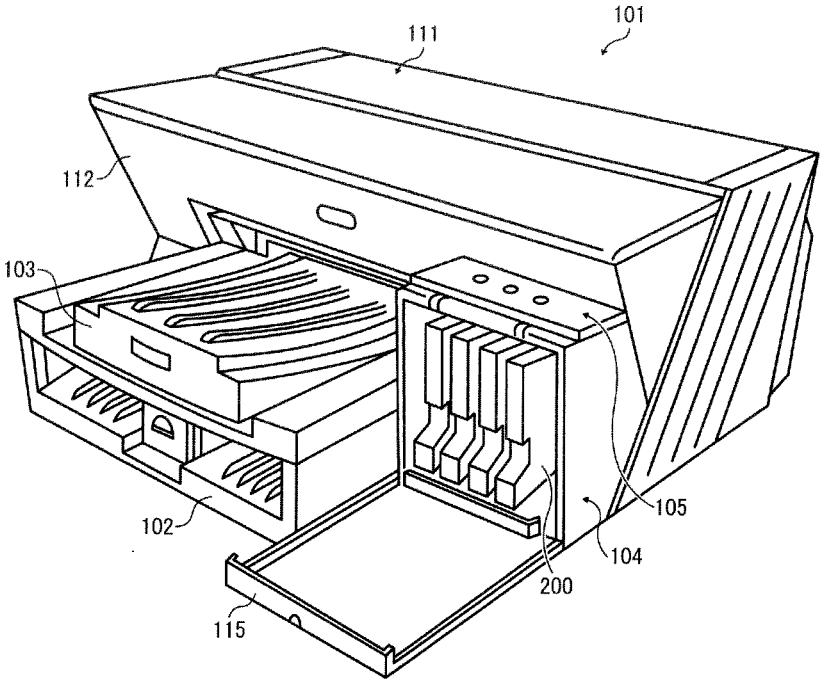
FIG. 1 is a schematic diagram illustrating an example of an ink jet recording apparatus according to an embodiment of the present invention.

An image forming method that uses an ink set according to the present disclosure uses a set of ink jet water-based inks to apply water-based inks of at least two colors to a heated nonporous substrate by an ink jet technique so as to form an image. Each water-based ink contains at least a coloring material, an emulsion resin, water, and a water-soluble solvent. At least one of the water-based inks has a minimum film-forming temperature different from the rest.

The minimum film-forming temperature a temperature at which the ink liquid solidifies and may be determined in accordance with Japanese Industrial Standards (JIS) K6828-2:2003 (Synthetic resin emulsion Part 2—Determination of white point temperature and minimum film-forming temperature). The minimum film-forming temperatures of the inks of respective colors can be determined thereby.

In this invention, ink droplets are applied to a heated nonporous substrate. Because the minimum film-forming temperature of at least one water-based ink is different from the rest, when two or more water-based inks of different colors are applied to share a border, at least one of the water-based inks dries faster, bleeding at the color border is suppressed, and high-quality images can be obtained.

A nonporous substrate refers to a resin film, a laminated paper sheet, a coated paper sheet, or the like, that has a surface composed of a transparent or colored plastic material such as a polyvinyl chloride film, a polyethylene terephthalate (PET) film, an acrylic film, a polypropylene film, a polyimide film, or a polystyrene film and that does not contain a paper component, such as wood pulp paper, Japanese paper, synthetic pulp paper, or synthetic fiber paper, in the surface.

According to the present disclosure, particularly in the case where a black ink in the ink set has a low minimum film-forming temperature, the flatness and smoothness of the ink droplets are enhanced and high gloss can be obtained by slightly slowing the drying of the inks other than the black ink. Moreover, since bleeding of the black ink that is particularly noticeable at the color border portions is suppressed, higher quality images can be formed.

The minimum film-forming temperature of the ink having the low minimum film-forming temperature is most preferably 5° C. to 10° C. lower than the minimum film-forming temperatures of other inks since bleeding is suppressed, image fixability and stability of the head unit remain affected, and high-quality images can be formed.

The minimum film-forming temperature of each ink forming an ink set preferably ranges from 30° C. to 80° C.

The water-based ink according to the present disclosure preferably contains at least a coloring material, an emulsion resin, water, and at least two water-soluble solvents. The minimum film-forming temperature can be adjusted by changing the type of emulsion resin, the type of water-soluble solvent, the ratio between water and the water-soluble solvent, the solid content, etc. However, two or more water-solvents are preferably used to change the ratio of the water-soluble solvent since the minimum film-forming temperature can be adjusted without significantly changing the viscosity of the ink liquid from one color to another.

Examples of the method of changing the type of the emulsion resin include a method in which a resin having a low glass transition temperature is used for an ink liquid of a particular color so as to lower the minimum film-forming temperature, a method in which the ratio of the water relative to the water-soluble solvent is increased for an ink liquid of a particular color so as to lower the minimum film-forming temperature, and a method in which two or more water-soluble solvents having different boiling points are mixed and the ratio of the water-soluble solvent having a lower boiling point is decreased in an ink liquid of a particular color so as to decrease the minimum film-forming temperature.

When two or more water-soluble solvents having different boiling temperatures are used, the difference in boiling point between the solvent having the highest boiling point among the solvents and the solvent having the lowest boiling point among the solvents is more preferably 10° C. to 40° C.

If the difference in boiling point is greater than 40° C., the difference in minimum film-forming temperature among inks of respective colors tends to become large. If the difference in boiling point is smaller than 10° C., it becomes difficult to adjust the minimum film-forming temperatures of the respective ink colors.

Among the coloring material, the emulsion resin, water, and the water-soluble solvents contained in the water-based ink of the present disclosure, the weight of the emulsion resin is preferably larger than the weight of the coloring material. When the weight of the emulsion resin is greater than the weight of the coloring material, the ink strongly solidifies on the heated nonporous substrate in a short time. More preferably, the ratio of the resin is increased. Since the color of the coloring material can be prevented from changing on the heated nonporous substrate by using the resin, a high-quality image can be formed.

An ink jet recording apparatus according to the present disclosure includes at least a heating device to heat a nonporous substrate so that ink droplets adhere to the heated nonporous substrate, an application device to apply the ink jet water-based ink of the present disclosure by applying energy to the water-based ink, and a transporting device to transport the nonporous substrate, in which the application device is typically an ink discharging device to record an image by discharging the ink.

An ink jet recording apparatus that can output high-quality images without thermal deformation of the substrate can be obtained if ink droplets are applied to the nonporous substrate heated to a range of from 30° C. to 80° C. Accordingly, the heating temperature is within such a range. A higher-quality image can be obtained by heating the nonporous substrate to a range of from 50° C. to 60° C.

In the ink jet recording apparatus, the ink discharging device applies energy to the ink jet water-based ink of the present disclosure, discharges the ink, and performs recording on the heated nonporous substrate.

As a result, a high-gloss image free of bleeding at the color border portions can be obtained.

As can be understood from the detailed and specific descriptions below, the present disclosure can solve the problems of the related art and provides a method for forming an image by using an ink jet water-based ink set, with which a high-gloss, high-resolution image free of bleeding is obtained by printing on a nonporous substrate and the ink can be strongly fixed to the nonporous substrate. The present disclosure also provides a stable ink jet recording apparatus that does not cause nozzle clogging even when left unused for a long time.

Water-Based Ink Set and Water-Based Ink

A water-based ink according to the present disclosure contains at least a coloring material, an emulsion resin, water, and a water-soluble solvent. A water-based ink set according to the present disclosure includes two or more such inks and each ink contains a different coloring material (including the cases where the ink is white or colorless).

Water-Soluble Solvent

A water-soluble solvent is a liquid component that is liquid at 25° C. and has a boiling point higher than that of water, and is a solvent that exhibits solubility in water. Examples of the water-soluble solvent include polyhydric alcohols, polyhydric alcohol alkyl ethers, polyhydric alcohol aryl ethers, nitrogen-containing heterocyclic compounds, amides, amines, sulfur-containing compounds, propylene carbonate, and ethylene carbonate.

Examples of the polyhydric alcohols include ethylene glycol, diethylene glycol, triethylene glycol, polyethylene glycol, propylene glycol, dipropylene glycol, tripropylene glycol, polypropylene glycol, 1,3-propanediol, 1,3-butanediol, 2,3-butanediol, 1,4-butanediol, 3-methyl-1,3-butanediol, 1,5-pentanediol, 1,6-hexanediol, 2-methyl-2,4-pentanediol, tetraethylene glycol, glycerin, 1,2,6-hexanetriol, 1,2,4-butanetriol, 1,2,3-butanetriol, 3-methyl-1,3,5-pentanetriol, 2-ethyl-1,3-hexanediol, and 2,2,4-trimethyl-1,3-pentanediol.

Examples of the polyhydric alcohol alkyl ethers include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, propylene glycol monoethyl ether.

Examples of the polyhydric alcohol aryl ethers include ethylene glycol monophenyl ether and ethylene glycol monobenzyl ether.

Examples of the nitrogen-containing heterocyclic compounds include N-methyl-2-pyrrolidone, N-hydroxyethyl-2-pyrrolidone, 2-pyrrolidone, 1,3-dimethylimidazolidinone, and ϵ-caprolactam.

Examples of the amides include formamide, N-methylformamide, and N,N-dimethylformamide.

Examples of the amines include monoethanolamine, diethanolamine, triethanolamine, monoethylamine, diethylamine, and triethylamine. Examples of the sulfur-containing compounds include dimethylsulfoxide, sulfolane, thiodiethanol, and thiodiglycol.

While any of these solvents can be used, the following solvents are preferable from the viewpoint of ink ejection stability: glycerin, 2-pyrrolidone, diethylene glycol, thiodiethanol, polyethylene glycol, triethylene glycol, 1,2,6-hexanetriol, 1,2,4-butanetriol, 3-methyl-1,3,5-pentanetriol, 1,5-pentanediol, N-methyl-2-pyrrolidone, 1,3-butanediol, and 3-methyl-1,3-butanediol. In particular, inclusion of any one of glycerin, 1,3-butanediol, 3-methyl-1,3-butanediol, and 2-pyrrolidone is preferable. In the case where two or more water-soluble solvents are used, it is preferable to use one of the preferable water-soluble solvents described above and a water-soluble solvent having a boiling point 10 T to 40° C. different from that of the preferable water-soluble solvent. The water-soluble solvent content is preferably in the range of 5% to 65% by weight and more preferably in the range of 15% to 55% by weight of the total weight of the water-based ink.

Emulsion Resin

An emulsion resin refers to resin fine particles dispersed in a continuous phase of water to form a resin emulsion. The resin fine particles may be of any type and may be selected in accordance with the intended purpose. Examples of the resin fine particles include fine particles of urethane resins, polyester resins, acrylic resins, vinyl acetate resins, styrenic resins, butadiene resins, styrene-butadiene resins, vinyl chloride resins, acryl styrene resins, and acryl silicone resins.

The emulsion resin may be synthesized as needed or purchased.

Examples of the commercially available emulsion resin include Microgel E-1002 and E-5002 (styrene-acrylic resin emulsions produced by Nippon Paint Co., Ltd.), VONCOAT 4001 (acrylic resin emulsion produced by DIC Corporation), VONCOAT 5454 (styrene-acrylic resin emulsion produced by DIC Corporation), SAE-1014 (styrene-acrylic resin emulsion produced by Nippon Zeon Co., Ltd.), SAIVINOL SK-200 (acrylic resin emulsion produced by Saiden Chemical Industry, Co., Ltd.), Primal AC-22 and AC-61 (acrylic resin emulsion produced by Rohm and Haas Company), Nanocryl SBCX-2821 and 3689 (acryl silicone resin emulsion produced by Toyo Ink Co., Ltd.), and #3070 (methyl methacrylate polymer resin emulsion produced by Mikuni Color Ltd.).

Among these resin fine particles, acrylic resin and urethane resin fine particles that offer good fixability on nonporous substrates and ink stability are more preferable.

In the present disclosure, different types of resins may be used depending on the colors of the inks in adjusting the minimum film-forming temperature. Here, "different types of resins" means that resins having different structures are used or if two or more emulsion resins are contained, the compositional ratio therein is different.

If needed, the emulsion resin may contain a dispersant such as a surfactant.

The particle size of the resin fine particles is preferably 10 to 1,000 nm and more preferably 100 to 300 nm in terms of volume-average particle size considering that they are used in an ink jet recording apparatus.

At a volume-average particle size less than 100 nm, it may become difficult to increase the amount of the emulsion to be added. Ata volume-average particle size exceeding 300 nm, the reliability may be degraded. This does not mean that emulsions having a particle size outside the above-described range cannot be used and is merely a statement of a general tendency irrespective of the emulsion types.

The volume-average particle size can be measured with a particle characterization instrument (Microtrac MODEL UPA9340 produced by Nikkiso Co., Ltd.), for example.

The emulsion resin content is preferably in the range of 1% to 10% by weight and more preferably in the range of 3% to 8% by weight of the total weight of the water-based ink from the viewpoint of fixability and ink stability.

Coloring Material

The coloring material may be any coloring material. Both pigments and dyes are suitable for use.

An ink containing a pigment as a coloring material exhibits good lightfastness. The pigment may be any common pigment for ink jet printing. Preferable examples of the pigment include (1) pigments with hydrophilic groups bonded to pigment surfaces, (2) polymer emulsion-type pigments constituted by polymer fine particles containing colorants insoluble or slightly soluble in water, and (3) microcapsule-type pigments obtained by coating pigments with resins having hydrophilic groups.

The pigments of group (1) above are pigments that have undergone surface modification so that at least one type of hydrophilic groups are bonded to pigment surfaces either directly or via other atomic groups.

This surface modification is carried out by causing a particular functional group (functional group such as a sulfonic group or a carboxylic group) to chemically bond to pigment surfaces or by wet-oxidation using at least one selected from hypohalous acid and salts thereof.

Preferably, the pigment has carboxyl groups bonded to pigment surfaces and is dispersed in water.

Since the pigment is surface-modified to have carboxyl groups bonded to the pigment surfaces, not only the dispersion stability is improved but also high-grade printing quality is achieved and water resistance of a recording medium after printing is further improved.

Since the ink of this type has good re-dispersibility after drying, clogging does not occur and printing can be smoothly and easily carried out by conducting a simple cleaning operation even when water in the ink near the nozzles of an ink jet head has evaporated after the ink jet head is left unused for a long time.

The volume-average particle size of this self-dispersion pigment in the ink is preferably 0.01 to 0.16 μm.

A polymer emulsion containing a colorant referred in relation to the pigments of group (2) above is either one or both of a polymer emulsion containing a pigment encapsulated in polymer fine particles and a polymer emulsion in which a pigment is adsorbed onto surfaces of polymer fine particles. Examples thereof are found in the description of Japanese Unexamined Patent Application Publication No. 2001-139849. Not all the pigment is necessarily encapsulated in the polymer fine particles or adsorbed onto the surfaces of the polymer fine particles. Some of the pigment may be dispersed in the emulsion as long as the effects of the present disclosure are not impaired.

The phrase "insoluble or slightly soluble in water" means that only up to 10 parts by mass of the colorant can be dissolved in 100 parts by mass of water at 20° C. Here, "dissolved" means that separation or settling of the colorant is not visually recognized in the surface layer or the lower layer of the aqueous solution.

The polymer that forms the polymer emulsion may be of any type and may be appropriately selected according to the intended purpose. Examples of the polymer include vinyl polymers, polyester polymers, polyurethane polymers, and polymers disclosed in Japanese Unexamined Patent Application Publication Nos. 2000-53897 and 2001-139849. Of these, vinyl polymers and polyester polymers are particularly preferable.

The volume-average particle size of the colorant-containing polymer fine particles (colored fine particles) in the ink is preferably in the range of 0.01 to 0.16 μm.

An ink containing the pigment of group (2) exhibits good lightfastness and fixability.

The pigments of group (3) above are obtained by coating a pigment with a hydrophilic resin insoluble in water so as to hydrophilize the surface of the pigment with the resin layer and disperse the pigment in water. Examples of such pigments include those described in Japanese Unexamined Patent Application Publication No. 2002-67473.

An ink containing a pigment of group (3) exhibits good lightfastness and fixability. Pigments of groups (2) and (3) are similar in that a pigment and a resin are integrally combined and are preferable in the present disclosure.

The coloring component of the coloring material may be any and may be appropriately selected according to the intended purpose. For example, the coloring component may be an inorganic pigment or an organic pigment.

Examples of the inorganic pigment include titanium oxide, iron oxide, calcium carbonate, barium sulfate, aluminum hydroxide, barium yellow, cadmium red, chromium yellow, and carbon black. Among these, carbon black and the like are preferable. Examples of the carbon black include those produced by known methods, such as a contact method, a furnace method, and a thermal method.

Examples of the organic pigment include azo pigments, polycyclic pigments, dye chelates, nitro pigments, nitroso pigments, and aniline black. Among these, azo pigments and polycyclic pigments are more preferable.

Examples of the azo pigment include azo lakes, insoluble azo pigments, condensed azo pigments, and chelate azo pigments.

Examples of the polycyclic pigment include phthalocyanine pigments, perylene pigments, perinone pigments, anthraquinone pigments, quinacridone pigments, dioxazine pigments, indigo pigments, thioindigo pigments, isoindolinone pigments, and quinophthalone pigments.

Examples of the dye chelates include basic dye chelates and acidic dye chelates.

The color of the pigment may be any and may be appropriately selected according to the intended purpose. The pigment may be black or any other color. These pigments may be used alone or in combination.

Examples of the black pigment include carbon black (C.I. Pigment Black 7) such as furnace black, lamp black, acetylene black and channel black, metals such as copper, iron (C.I. Pigment black 11), and titanium oxide, and organic pigments such as aniline black (C.I. Pigment Black 1).

Examples of the color pigments include those for yellow inks such as C.I. Pigment Yellow 1 (fast yellow G), 3, 12 (disazo yellow AAA), 13, 14, 17, 23, 24, 34, 35, 37, 42 (yellow iron oxide), 53, 55, 74, 81, 83 (disazo yellow HR), 95, 97, 98, 100, 101, 104, 108, 109, 110, 117, 120, 128, 138, 150, and 153. Examples of the color pigments for magenta inks include C.I. Pigment Red 1, 2, 3, 5, 17, 22 (brilliant fast scarlet), 23, 31, 38, 48:2 (permanent red 2B (Ba)), 48:2 (permanent red 2B (Ca)), 48:3 (permanent red 2B (Sr)), 48:4 (permanent red 2B (Mn)), 49:1, 52:2, 53:1, 57:1 (brilliant carmine 6B), 60:1, 63:1, 63:2, 64:1, 81 (rhodamine 6G lake), 83, 88, 92, 101 (iron oxide red), 104, 105, 106, 108 (cadmium red), 112, 114, 122 (dimethylquinacridone), 123, 146, 149, 166, 168, 170, 172, 177, 178, 179, 185, 190, 193, 209, and 219.

Examples of the color pigments for cyan inks include C.I. Pigment Blue 1, 2, 15 (copper phthalocyanine blue R), 15:1, 15:2, 15:3 (phthalocyanine blue G), 15:4, 15:6 (phthalocyanine blue E), 16, 17:1, 56, 60, and 63.

Examples of the color pigments for intermediate color inks include those for red, green, and blue inks such as C.I. Pigment Red 177, 194, and 224, C.I. Pigment Orange 43, C.I. Pigment Violet 3, 19, 23, and 37, and C.I. Pigment Green 7 and 36.

An ink containing a dye as a coloring material exhibits good color tone. Examples of the dye include water-soluble dyes, oil-soluble dyes, and dispersion dyes.

Examples of the water-soluble dyes include dyes classified as acidic dyes, direct dyes, basic dyes, reactive dyes, and food dyes in the color index. Dyes having good water resistance and lightfastness are preferably used.

Examples of the acidic dye and the food dye include C.I. Acid Yellow 17, 23, 42, 44, 79, and 142; C.I., Acid Red 1, 8, 13, 14, 18, 26, 27, 35, 37, 42, 52, 82, 87, 89, 92, 97, 106, 111, 114, 115, 134, 186, 249, 254, and 289; C.I. Acid Blue 9, 29, 45, 92, and 249; C.I. Acid Black 1, 2, 7, 24, 26, and 94; C.I. Food Yellow 3 and 4; C.I. Food Red 7, 9, and 14; and C.I. Food Black 1 and 2.

Examples of the direct dye include C.I. Direct Yellow 1, 12, 24, 26, 33, 44, 50, 86, 120, 132, 142, and 144; C.I. Direct Red 1, 4, 9, 13, 17, 20, 28, 31, 39, 80, 81, 83, 89, 225, and 227; C.I. Direct Orange 26, 29, 62, and 102; C.I. Direct Blue 1, 2, 6, 15, 22, 25, 71, 76, 79, 86, 87, 90, 98, 163, 165, 199, and 202; and C.I. Direct Black 19, 22, 32, 38, 51, 56, 71, 74, 75, 77, 154, 168, and 171.

Examples of the basic dye include C.I. Basic Yellow 1, 2, 11, 13, 14, 15, 19, 21, 23, 24, 25, 28, 29, 32, 36, 40, 41, 45, 49, 51, 53, 63, 64, 65, 67, 70, 73, 77, 87, and 91; C.I. Basic Red 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, and 112; C.I. Basic Blue 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, and 155; and C.I. Basic Black 2 and 8.

Examples of the reactive dye include C.I. Reactive Black 3, 4, 7, 11, 12, and 17; C.I. Reactive Yellow 1, 5, 11, 13, 14, 20, 21, 22, 25, 40, 47, 51, 55, 65, and 67; C.I. Reactive Red 1, 14, 17, 25, 26, 32, 37, 44, 46, 55, 60, 66, 74, 79, 96, and 97; and C.I. Reactive Blue 1, 2, 7, 14, 15, 23, 32, 35, 38, 41, 63, 80, and 95.

The coloring material content is preferably in the range of 0.5% to 8% by weight and more preferably in the range of 1% to 6% by weight of the total weight of the water-based ink from the viewpoints of image density and ink stability.

The water-based ink of the present disclosure at least contains a coloring material, an emulsion resin, water, and a water-soluble solvent. If needed, a surfactant may be added as described below.

Surfactant

The surfactant to be added may be any surfactant and may be selected according to the intended purpose from among surfactants that do not impair dispersion stability while considering the type of coloring material, the combination of a humectant and a penetrant, etc. A surfactant having a low surface tension and a high leveling property is preferable. The surfactant to be added is preferably at least one surfactant selected from among silicone surfactants and fluorine surfactants. A fluorine surfactant is particularly preferable.

The fluorine surfactant preferably has 2 to 16 carbon atoms and more preferably 4 to 16 carbon atoms that are substituted with fluorine. If the number of the carbon atoms substituted with fluorine is less than 2, the effect of the fluorine may not always be exhibited. A surfactant with more than sixteen carbon atoms substituted with fluorine may degrade ink storage property.

Examples of the fluorine surfactant include perfluoroalkyl sulfonic acid compounds, perfluoroalkyl carboxylic acid compounds, perfluoroalkyl phosphoric acid ester compounds, perfluoroalkyl ethylene oxide adducts, and polyoxyalkylene ether polymer compounds having perfluoroalkyl ether groups in side chains.

Among these, polyoxyalkylene ether polymer compounds having perfluoroalkyl ether groups in side chains are particularly preferable for their low foamability.

Examples of the perfluoroalkyl sulfonic acid compound include perfluoroalkyl sulfonic acid and perfluoroalkyl sulfonic acid salts. Examples of the perfluoroalkyl carboxylic acid compounds include perfluoroalkyl carboxylic acid and perfluoroalkyl carboxylic acid salts. Examples of the perfluoroalkyl phosphoric acid ester compounds include perfluoroalkyl phosphoric acid ester and perfluoroalkyl phosphoric acid ester salts. Examples of the polyoxyalkylene ether polymer compounds having perfluoroalkyl ether groups in side chains include polyoxyalkylene ether polymers having perfluoroalkyl ether groups in side chains, sulfuric acid ester salts of polyoxyalkylene ether polymers having perfluoroalkyl ether groups in side chains, and salts of polyoxyalkylene ether polymers having perfluoroalkyl ether groups in side chains.

Examples of the counter ions of the salts of these fluorine surfactants include Li, Na, K, $NH_4$, $NH_3CH_2CH_2OH$, $NH_2(CH_2CH_2OH)_2$, and $NH(CH_2CH_4OH)_3$.

The fluorine surfactant may be synthesized as needed or purchased.

Examples of the commercially available fluorine surfactant include Surflon S-111, S-112, S-113, S-121, S-131, S-132, S-141, and S-145 (all produced by Asahi Glass Co., Ltd.); Fluorad FC-93, FC-95, FC-98, FC-129, FC-135, FC-170C, FC-430, and FC-431 (all produced by Sumitomo 3M Limited); Megafac F-470, F1405, and F-474 (all produced by DIC Corporation); Zonyl TBS, FSP, FSA, FSN-100, FSN, FSO-100, FSO, FS-300, and UR (all produced by DuPont); FT-110, FT-250, FT-251, FT-400S, FT-150, and FT-400SW (all produced by Neos Company Limited); and PF-151N (produced by Omnova Solutions Inc.). Among these, FT-110, FT-250, FT-251, FT-400S, FT-150, and FT-400SW produced by Neos Company Limited and PF-151N produced by Omnova Solutions Inc., are particularly preferable since they help achieve high printing quality and, in particular, significantly improve the coloring property and leveling property on paper.

The silicone surfactant may be of any type and may be appropriately selected according to the intended purpose. The silicone surfactant is preferably one that does not decompose at high pH. Examples thereof include side chain-modified polydimethylsiloxane, two-terminal-modified polydimethylsiloxane, one-terminal-modified polydimethylsiloxane, and side-chain-, two-terminal-modified polydimethylsiloxane. The modifying group is preferably a polyoxyethylene group or a polyoxyethylene polyoxypropylene group since such a surfactant exhibits particularly favorable properties as a water-based surfactant. Such a surfactant can be synthesized as needed or purchased.

Such a surfactant can be easily purchased from BYK Japan KK, Shin-Etsu Silicones, Toray Dow Corning Silicones, etc.

The polyether-modified silicone surfactant may be of any type. Examples of the commercially available product include KF-618, KF-642, and KF643 (all produced by Shin-Etsu Chemical Co., Ltd.).

Anionic surfactants, nonionic surfactants, and amphoteric surfactants can also be used in addition to the fluorine surfactants and silicone surfactants.

Examples of the anionic surfactants include salts such as polyoxyethylene alkyl ether acetic acid salts, dodecylbenzene sulfonic acid salts, succinic acid ester sulfonic acid salts, lauric acid salts, and polyoxyethylene alkyl ether sulfate.

Examples of the nonionic surfactants include acetylene glycol surfactants, polyoxyethylene alkyl ethers, polyoxyethylene alkyl phenyl ethers, polyoxyethylene alkyl esters, and polyoxyethylene sorbitan fatty acid esters.

Examples of the acetylene glycol surfactants include 2,4,7,9-tetramethyl-5-decyne-4,7-diol, 3,6-dimethyl-4-octyne-3,6-diol, 3,5-dimethyl-1-hexyn-3-ol.

Examples of the commercially available products of acetylene glycol surfactants include Surfynol 104, 82, 465, 485, and TG produced by Air Products and Chemicals, Inc. (US).

Examples of the amphoteric surfactants include laurylaminopropionic acid salts, lauryl dimethyl betaine, stearyl dimethyl betaine, lauryl dihydroxyethyl betaine, lauryldimethylamine oxide, myristyl dimethylamine oxide, stearyl dimethylamine oxide, dihydroxyethyl lauryl amine oxide, polyoxyethylene coconut oil alkyl dimethylamine oxide, dimethyl alkyl(coco)betaine, and dimethyl lauryl betaine.

These surfactants can be easily purchased from Nikko Chemicals Co., Ltd., Nihon Emulsion Co., Ltd., Nippon Shokubai Co., Ltd., Toho Chemical Industry Co., Ltd., Kao Corporation, Adeka Corporation, Lion Corporation, Aoki Oil Industrial Co., Ltd., Sanyo Chemical Industries, Ltd., and the like.

The surfactant is not limited to the above-mentioned surfactants. These surfactants may be used alone or in combination as a mixture.

A surfactant that is not readily dissolvable alone in a recording ink can be easily dissolved and stabilized if it is used in a mixture.

The surfactant content in the water-based ink is preferably 0.01% to 3% by weight and more preferably 0.5% to 2% by weight.

At a surfactant content less than 0.01% by weight, the effect of adding the surfactant may not be exhibited. At a surfactant content exceeding 3% by weight, the wettability to the nonporous substrate is excessively increased, possibly resulting in lower image density and bleeding at color border portions.

Other components may be added without any limitation. Suitable components may be selected as needed. Examples of such components include a defoamer, a preservative fungicide, an anti-rust agent, a pH adjustor, a resistivity adjustor, an antioxidant, an ultraviolet (UV) absorber, an oxygen absorber, a light stabilizer, and a viscosity adjustor.

The defoamer may be any defoamer and may be appropriately selected according to the intended purpose. Examples of the defoamer include silicone defoamers, polyether defoamers, fatty acid ester defoamers. These may be used alone or in combination. Among these, silicone defoamers are preferable for their excellent foam-breaking effects.

Examples of the silicone defoamer include oil-type silicone defoamers, compound-type silicone defoamers, self-emulsifying-type silicone defoamers, emulsion-type silicone defoamers, and modified silicone defoamers.

Examples of the modified silicone defoamers include amino-modified silicone defoamers, carbinol-modified silicone defoamers, methacryl-modified silicone defoamers, polyether-modified silicone defoamers, alkyl-modified silicone defoamers, higher fatty acid ester-modified silicone defoamers, and alkylene oxide-modified silicone defoamers. Among these, self-emulsifying-type silicone defoamers and emulsion-type silicone defoamers are preferable from the viewpoint of use in a recording ink containing a water-based medium.

The defoamer may be purchased. Examples of the commercially available defoamer include silicone defoamers produced by Shin-Etsu Chemical Co., Ltd. (KS508, KS531, KM72, KM85, and the like), silicone defoamers produced by Toray Dow Corning (Q2-3183A, SH5510, and the like), silicone defoamers produced by Nippon Unicar Company Limited (SAG30 and the like), and defoamers produced by Adeka Corporation (Adeka Nate series and the like).

The defoamer content in the recording ink may be any and may be appropriately selected according to the intended purpose. For example, the defoamer content is preferably 0.001% to 3% by weight and more preferably 0.05% to 0.5% by weight.

Examples of the preservative fungicide include 1,2-benzisothiazolin-3-on, sodium dehydroacetate, sodium sorbate, sodium 2-pyridinethiol-1-oxide, sodium benzoate, and pentachlorophenol sodium.

A resistivity adjustor such as an inorganic salt, e.g., a halide of an alkali metal or halogenated ammonium (lithium chloride, ammonium chloride, sodium chloride, or the like), may be added to prepare a recording liquid that can be used in an ink jet recording method that involves electrically charging the recording ink.

The pH adjustor may be any pH adjustor as long as it does not adversely affect the ink and is capable of adjusting pH to 7 or higher. Any substance that suits the purpose can be used. Examples of the pH adjustor include amines such as diethanolamine and triethanolamine, hydroxides of alkali metals such as lithium hydroxide, sodium hydroxide, and potassium hydroxide, ammonium hydroxide, quaternary ammonium hydroxide, quaternary phosphonium hydroxide, and carbonates of alkali metals such as lithium carbonate, sodium carbonate, and potassium carbonate.

Examples of the anti-rust agent include acidic sulfites, sodium thiosulfate, ammonium thiodiglycolate, diisopropyl ammonium nitrite, pentaerythritol tetranitrate, and dicyclohexylammonium nitrite.

Examples of the antioxidant include phenolic antioxidants (including hindered phenol antioxidants), amine antioxidants, sulfur antioxidants, and phosphorus antioxidants.

Examples of the phenolic antioxidant (including hindered phenol antioxidants) include butylated hydroxyanisole, 2,6-di-tert-butyl-4-ethylphenol, stearyl-β-(3,5-di-tert-butyl-4-hydroxyphenyl)propionate, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 3,9-bis[1,1-dimethyl-2-[β-(3-tert-butyl-4-hydroxy-5-methylphenyl)propionyloxy]ethyl]2,4,8,10-tetraoxaspiro[5,5]undecane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, and tetrakis [methylene-3-(3',5'-di-tert-butyl-4'-hydroxyphenyl) propionate]methane.

Examples of the amine antioxidant include phenyl-β-naphthylamine, α-naphthylamine, N,N'-di-sec-butyl-p-phenylenediamine, phenothiazine, N,N'-diphenyl-p-phenylenediamine, 2,6-di-tert-butyl-p-cresol, 2,6-di-tert-butylphenol, 2,4-dimethyl-6-tert-butyl-phenol, butylhydroxyanisole, 2,2'-methylenebis(4-methyl-6-tert-butylphenol), 4,4'-butylidenebis(3-methyl-6-tert-butylphenol), 4,4'-thiobis(3-methyl-6-tert-butylphenol), tetrakis[methylene-3(3,5-di-tert-butyl-4-dihydroxyphenyl)propionate]methane, and 1,1,3-tris (2-methyl-4-hydroxy-5-tert-butylphenyl)butane.

Examples of the sulfur antioxidants include dilauryl-3,3'-thiodipropionate, distearylthiodipropionate, lauryl stearyl thiodipropionate, dimyristyl-3,3'-thiodipropionate, distearyl-β,β'-thiodipropionate, 2-mercaptobenzimidazole, and dilauryl sulfide.

Examples of the phosphorus antioxidants include triphenyl phosphite, octadecyl phosphite, triisodecyl phosphite, trilauryltrithio phosphite, and trinonyl phenyl phosphite.

Examples of the UV absorber include benzophenone UV absorbers, benzotriazole UV absorbers, salicylate UV absorbers, cyanoacrylate UV absorbers, and nickel complex salt UV absorbers.

Examples of the benzophenone UV absorbers include 2-hydroxy-4-n-octoxybenzophenone, 2-hydroxy-4-n-dodecyloxyhenzophenone, 2,4-dihydroxybenzophenone, 2-hydroxy-4-methoxybenzophenone, and 2,2',4,4'-tetrahydroxybenzophenone.

Examples of the benzotriazole UV absorbers include 2-(2'-hydroxy-5'-tert-octylphenyl)benzotriazole, 2-(2'-hydroxy-5'-methylphenyl)benzotriazole, 2-(2'-hydroxy-4'-octoxyphenyl)benzotriazole, and 2-(2'-hydroxy-3'-tert-butyl-5'-methylphenyl)-5-chlorobenzotriazole.

Examples of the salicylate UV absorbers include phenyl salicylate, p-tert-butylphenyl salicylate, and p-octylphenyl salicylate.

Examples of the cyanoacrylate UV absorbers include ethyl-2-cyano-3,3'-diphenyl acrylate, methyl-2-cyano-3-methyl-3-(p-methoxyphenyl) acrylate, and butyl-2-cyano-3-methyl-3-(p-methoxyphenyl) acrylate.

Examples of the nickel complex salt UV absorbers include nickel bis(octylphenyl) sulfide, 2,2'-thiobis(4-tert-octylphenolato)-n-butylamine nickel(II), 2,2'-thiobis(4-tert-octylphenolato)-2-ethylhexylamine nickel(II), and 2,2'-thiobis(4-tert-octylphenolato)triethanolamine nickel(II).

The water-based ink according to the present disclosure contains at least a coloring material, an emulsion resin, water, and a water-soluble solvent. If needed, other components may be dispersed or dissolved in a water-based medium and added and the water-based ink may be made by stirring the resulting mixture as needed.

It should be noted that the coloring material and the resin used here are usually preliminarily dissolved or dispersed in water.

A sand mill, a homogenizer, a ball mill, a paint shaker, an ultrasonic disperser, or other suitable instruments may be used to perform dispersing. A common stirrer equipped with a stirring blade, a magnetic stirrer, a high-speed disperser, and other suitable devices may be used to perform stirring and mixing.

The physical properties of the water-based ink according to the present disclosure are not particularly limited and may be selected according to the intended purpose. For example, the viscosity, surface tension, and pH are preferably within the following ranges.

The viscosity of the water-based ink at 25° C. is preferably 20 mPa·s or less and more preferably 15 mPa·s or less.

At a viscosity exceeding 20 mPa·s, the discharge stability may not always be ensured. Note that some head structures are compatible with inks having such a high viscosity.

The surface tension of the water-based at 25° C. is preferably 35 mN/m or less and more preferably 30 mN/m or less. At a surface tension exceeding 35 mN/m, the ink on the recording medium is not easily leveled and may take a longer time to dry.

The pH of the water-based ink is preferably 7 to 10, for example.

The ink set includes recording inks of at least two colors. The color may be any color and may be selected according to the intended purpose. Examples of the color include yellow, magenta, cyan, and black. An ink set that includes a black ink and at least one other color ink (for example, a yellow, magenta, or cyan ink) is preferable since the effect of the present disclosure is enhanced.

The water-based ink according to the present disclosure is suitable for use in any type of printers equipped with an ink jet head. Examples of the ink jet head include a piezoelectric ink jet head that includes piezoelectric elements to pressurize the ink in ink channels and discharges ink droplets by deforming vibrating plates constituting walls of the ink channels and thereby changing the volumes in the ink channels (for example, refer to Japanese Unexamined Patent Application Publication No. 2-51734), a thermal ink jet head that generates bubbles by heating the ink in the ink channels with heat elements (for example, refer to Japanese Unexamined Patent Application Publication No. 61-59911), and an electrostatic ink jet head that includes a vibrating plate constituting a wall of an ink channel and an electrode arranged to oppose the vibrating plate and discharges ink droplets by deforming the vibrating plate by electrostatic force generated between the vibrating plate and the electrode and thereby changing the volume in the ink channels (for example, refer to Japanese Unexamined Patent Application Publication No. 6-71882).

Ink Jet Recording Apparatus

An ink jet recording apparatus according to the present disclosure includes at least an ink discharging device to apply energy to the ink jet water-based ink and discharge the water-based ink to record an image, a transporting device to transport a nonporous substrate which is a plastic film such as vinyl chloride resin film, a PET film, or a polycarbonate film, and a heating device to heat the nonporous substrate to fix ink droplets onto the nonporous substrate.

The ink discharge device applies a stimulus to the water-based ink of the present disclosure so as to discharge the ink and form images.

The ink discharge device may be of any type and may be selected according to the intended purpose. Examples of the ink discharge device include various types of recording heads (ink ejection heads). An Ink discharge device that includes a head that includes plural nozzle rows and a subtank that stores a liquid supplied from a liquid reservoir and supplies the liquid to the head is preferably used.

The subtank preferably includes a negative pressure generating device to negatively pressurizing the subtank, a releasing device to release pressure inside the subtank, and a detecting device to detect presence or absence of the ink based on the difference in electrical resistance.

The stimulus can be generated by a stimulus generating device. The stimulus may be of any type and may be selected according to the intended purpose. Examples of the stimulus include heat (temperature), pressure, vibrations, and light, which can be used alone or in combination. Heat and pressure are particularly preferable.

Examples of the stimulus generating device include a heating device, a pressurizing device, a piezoelectric element, a vibrator, an ultrasonic oscillator, and a lighting device. More specific examples of the stimulus generating device include piezoelectric actuators such as piezoelectric elements, thermal actuators that utilize phase changes caused by film-boiling a liquid with electro-thermal converters such as heat elements, shape memory alloy actuators that utilize metal phase changes caused by temperature changes, and electrostatic actuators that utilize electrostatic force.

The recording ink may be discharged by any type of system. The system differs depending on the type of stimulus. For example, when the stimulus is heat, thermal energy corresponding to a recording signal is applied to the recording ink in the recording head by using, for example, a thermal head, so as to generate bubbles in the recording ink, and the pressure generated by the bubbles is used to discharge droplets of the recording ink from nozzle openings of the recording head.

When the stimulus is pressure, a voltage is applied to a piezoelectric element bonded to a pressure chamber of the ink channel of the recording head so as to deform the piezoelectric element and decrease the volume of the pressure chamber, and droplets of the recording ink are ejected from nozzle openings of the recording head.

A piezoelectric method with which a voltage is applied to a piezoelectric element to discharge the recording ink is preferable. Since the piezoelectric method does not require heating, the piezoelectric method is advantageous for discharging an ink that contains a resin. The piezoelectric method is particularly effective for an ink having a low humectant content since nozzle clogging can be suppressed.

In order to prevent missing dots, idle scanning is preferably performed by applying voltage, which is not high enough to cause ink discharge, to the piezoelectric elements.

Furthermore, before completion of the idle scanning corresponding to one page of printing, operation of discharging the ink into the ink storing unit is preferably conducted.

Furthermore, a removing device to remove the ink in an idle discharge receiver is preferably provided. The removing device is preferably a wiper or a cutter.

The ink jet recording apparatus according to the present disclosure also includes a transporting device to transport a nonporous substrate. Known transporting devices such as a transport roller and a transport belt can be used as the transporting device, for example.

The ink jet recording apparatus according to the present disclosure also includes a heating device to heat a nonporous substrate in order to apply the ink to a heated nonporous substrate.

Known heating devices such as a transport roller or belt equipped with a heater or a guide member equipped with heater in which one or more known heating devices selected from existing heating devices can be used can be used as the heating device. The heater may be a built-in heater of an existing ink jet printer or an external heater for an existing ink jet printer.

An embodiment of the ink jet recording apparatus according to the present disclosure will now be described with reference to drawings.

FIG. 1 is a schematic view of an example of the ink jet recording apparatus according to the present disclosure.

The ink jet recording apparatus shown in FIG. 1 includes a main body 101, a tray 102 mounted into the main body 101 and used for loading a nonporous substrate, a tray 103 mounted into the main body 101 and used for storing nonporous substrates having images recorded (formed) thereon, and an ink cartridge loading unit 104. An operation unit 105 that includes operation keys and an indicator is disposed on an upper surface of the ink cartridge loading unit 104. The ink cartridge loading unit 104 has a front cover 115 that can be opened when attaching an ink cartridge 200. The ink jet recording apparatus also includes an upper cover 111 and a front surface 112 of a front cover.

Figure 2:
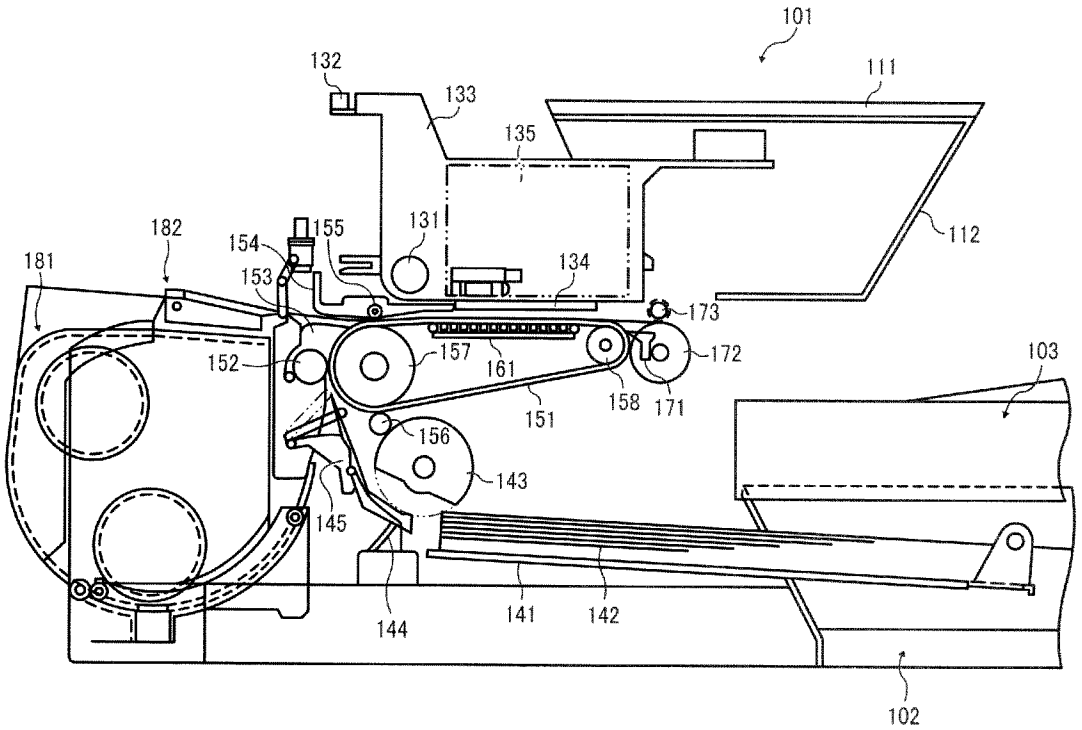
FIG. 2 is a schematic diagram illustrating an example of an internal structure of the ink jet recording apparatus illustrated in FIG. 1.

Referring now to FIG. 2, a guide rod 131 which is a guiding member that lies across left and right side plates (not shown) and a stay 132 are disposed inside the main body 101. A carriage 133 is slidably retained in a main scanning direction by the guide rod 131 and the stay 132 and moved and scanned by a main scanning motor (not shown).

A recording head 134 is mounted into the carriage 133 so that ink discharge ports of the recording head 134 are aligned in a direction orthogonal to the main scanning direction in such a manner that the ink droplets are discharged in a downward direction. The recording head 134 includes four ink jet recording heads that respectively discharge ink droplets of yellow (Y), cyan (C), magenta (M), and black (Bk).

Each ink jet recording head constituting the recording head 134 can be an ink jet recording head equipped with a device for generating energy needed to discharge the ink, such as a piezoelectric actuator such as a piezoelectric element, a thermal actuator that utilizes the phase change caused by film-boiling of a liquid using an electro-thermal converter such as a heat element, a shape memory alloy actuator that utilizes the metal phase changes caused by temperature changes, or an electrostatic actuator that utilizes electrostatic force.

Subtanks 135 for supplying inks of respective colors to the recording head 134 are mounted into the carriage 133. The inks of the ink set according to the present disclosure are replenished from the ink cartridge 200 of the present disclosure in the ink cartridge loading unit 104 to the subtanks 135 via ink supply tubes (not shown in the drawing).

A sheet feeding unit for feeding a nonporous substrate 142 loaded on a nonporous substrate storing unit (pressure plate) 141 of the tray 102 includes a half-moon roller (sheet feeding roller 143) that picks up one nonporous substrate 142 at a time from the nonporous substrate storing unit 141 and a separation pad 144 arranged to oppose the sheet feeding roller 143 and composed of a material having a large frictional coefficient. The separation pad 144 is urged toward the sheet feeding roller 143.

The nonporous substrate 142 fed from the sheet feeding unit is transported by a transport unit that transports the nonporous substrate 142 at the lower side of the recording head 134. The transport unit includes a transport belt 151, a counter roller 152, a transport guide 153, and a leading end pressurizing roller 155. The nonporous substrate 142 is transported by the transport belt 151 by electrostatic suction. The nonporous substrate 142 fed through the guide 145 from the sheet feeding unit is sandwiched between the transport belt 151 and the counter roller 152 and transported. The course of the nonporous substrate 142 transported upward in a substantially perpendicular direction is then changed by about 90° by the transport guide 153 so that the nonporous substrate 142 travels along the transport belt 151. The leading end pressurizing roller 155 is urged toward the transport belt 151 with a pushing member 154. The transport unit also includes a charging roller 156 configured to charge the surface of the transport belt 151.

The transport belt 151 is an endless belt stretched across a heater-type transport roller 157 and a tension roller 158 and can rotate in a belt transporting direction. The transport belt 151 includes a surface layer and a back layer (intermediate resistance layer or earth layer). The surface layer is formed of a resin member having a thickness of about 40 μm whose resistance is not adjusted, for example, a resin member composed of a copolymer of tetrafluoroethylene and ethylene (ETFE). The back layer is made of the same material as the surface layer but has resistance controlled by addition of carbon. A heater-type guiding member 161 is disposed on the rear side of the transport belt 151 so as to correspond to the printing region on which printing is conducted with the recording head 134. A sheet ejection unit for ejecting the nonporous substrate 142 on which printing is performed with the recording head 134 is also provided. The sheet ejection unit includes a separation claw 171 for separating the nonporous substrate 142 from the transport belt 151, a sheet ejection roller 172, and a sheet ejection roller 173. After the nonporous substrate 142 is dried with a fan heater 174 by hot air, the nonporous substrate 142 is output to the tray 103 under the sheet ejection roller 172.

A duplex feed unit 181 is removably attached to the back surface of the main body 101. The duplex feed unit 181 is configured to take in the nonporous substrate 142 returned by a reverse rotation of the transport belt 151 and flip the nonporous substrate 142 so that the nonporous substrate 142 is again fed to a nip between the counter roller 152 and the transport belt 151. A manual sheet feed unit 182 is disposed on the upper surface of the duplex feed unit 181.

In this ink jet recording apparatus, one nonporous substrate 142 is fed from the sheet feed unit each time. The nonporous substrate 142 fed upward in a substantially perpendicular direction is guided by the guide 145 and is transported due to the nonporous substrate 142 being sandwiched between the transport belt 151 and the counter roller 152. The leading end of the nonporous substrate 142 is guided by the transport guide 153 and pressed against the transport belt 151 by the leading end pressurizing roller 155. Then the direction in which the nonporous substrate 142 is transported is changed by about 90°.

At this stage, the transport belt 151 is electrically charged by the charging roller 156 and the nonporous substrate 142 is electrically suctioned by the transport belt 151 and is transported.

While the carriage 133 is moved, the recording head 134 is driven in response to an image signal. As a result, ink droplets are discharged onto the nonporous substrate 142 to perform one line of printing. After the nonporous substrate 142 is transported by a particular distance, recording of the next line is performed. Recording operation ends in response to a recording end signal or a signal that indicates that the trailing end of the nonporous substrate 142 has reached the recording region. Then the nonporous substrate 142 is ejected onto the tray 103.

In the description above, a serial-type (shuttle-type) inkjet recording apparatus in which the carriage is scanned has been explained. However, the present disclosure can also be applied to a line-type ink jet recording apparatus equipped with a line-type head.

The ink jet recording apparatus according to the present disclosure can be applied to various types of ink jet recording. For example, the ink jet recording apparatus is suitable for use in ink jet recording printers, facsimile machines, copy machines, and multifunction printers (printer/fax/copier).

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is now specifically described in detail with reference to Examples but is not limited thereto.

Pigment Dispersion Production Example

Mixtures having compositions below were each pre-mixed and then dispersed in a disk-type bead mill (type KDL produced by Shinmaru Enterprises Corporation, media: zirconia balls 0.3 mm in diameter) for 7 hours. As a result, four pigment liquid dispersions were obtained.

Black

| | |
|---|---|
| Carbon black pigment: | 15 parts by weight |
| Anionic surfactant (PIONIN A-51-B produced by Takemonto Oil & Fat Co., Ltd.): | 2 parts by weight |
| Ion exchange water: | 83 parts by weight |

Magenta

| | |
|---|---|
| C.I. Pigment Red 122: | 15 parts by weight |
| Anionic surfactant (PIONIN A-51-B produced by Takemonto Oil & Fat Co., Ltd.): | 2 parts by weight |
| Ion exchange water: | 83 parts by weight |

Cyan

| | |
|---|---|
| Copper phthalocyanine pigment: | 15 parts by weight |
| Anionic surfactant (PIONIN A-51-B produced by Takemonto Oil & Fat Co., Ltd.): | 2 parts by weight |
| Ion exchange water: | 83 parts by weight |

Yellow

| | |
|---|---|
| C.I. Pigment Yellow 74: | 15 parts by weight |
| Anionic surfactant (PIONIN A-51-B produced by Takemonto Oil & Fat Co., Ltd.): | 2 parts by weight |
| Ion exchange water: | 83 parts by weight |

Example 1

Mixtures having compositions shown below and containing the pigment liquid dispersions described above were each mixed, stirred, and filtered with a 0.2 μm polypropylene filter to prepare inks.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |

-continued

| | |
|---|---|
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

The inks prepared as above were evaluated as below.

Minimum Film-Forming Temperature Measurement

An ink was applied to a compact minimum film-forming temperature meter (Produced by Imoto Machinery Co., Ltd.) with a blade coat and the minimum film-forming temperature was measured in accordance with Japanese Industrial Standards (JIS) K6828-2:2003 (Synthetic resin emulsion Part 2—Determination of white point temperature and minimum film-forming temperature). In particular, an ink was applied to a thickness of 0.3 mm with an applicator and left standing for 30 minutes to dry. The surface of the applied ink was traced with a glass rod and the temperature at which scratches were formed on the surface was assumed to be the minimum film-forming temperature. The difference between the largest minimum film-forming temperature exhibited by an ink of a particular color and the smallest minimum film-forming temperature exhibited by an ink of a particular color was determined.

Color Border Bleeding

The inks prepared were loaded into an ink jet printer (IP-SiO GXe5500 produced by Ricoh Company, Ltd.) modified to include a heater in a sheet transport belt so that the printer could perform printing on a nonporous medium heated to 55° C. Two single-color solid images each 30×30 mm in size were printed next to each other on a polyvinyl chloride film (polyvinyl chloride film with gray glue, LSPV1270GT produced by Sakurai Co., Ltd.) in a high-grade high-image-quality mode. A total of six combinations of the single-color solid images, namely, black-magenta, black-cyan, black-yellow, magenta-cyan, magenta-yellow, and cyan-yellow were printed and then dried with hot air.

Next, the printed images were evaluated in terms of color border bleeding based on the following criteria:

Evaluation Criteria

AA: No color border bleeding was observed and the image quality overall was satisfactory.

A: Very little color border bleeding was observed but the image quality overall was satisfactory.

B: Minor color border bleeding was observed but the image quality overall was acceptable.

C: Extensive color border bleeding was observed.

Image Gloss

The solid portions of the printed images formed as described above were measured with a gloss meter (4501 produced by BYK Gardener) to determine the 60° gloss of the solid portions. The average gloss of each color was determined and rated according to the following criteria.

AA: The 60° gloss was larger than 100%.
A: The 60° gloss was 81% to 100%.
B: The 60° gloss was 60% to 80%.
C: The 60° gloss was less than 60%.

Substrate Fixability

The substrate fixability of the solid portions of the printed images formed as above was evaluated by performing an abrasive resistance test. The solid portions were scrubbed with an eraser (GAZA (ink & pencil) produced by Lion Office Products Corporation) at a load of 1 kg/cm$^2$ for 50 reciprocal motions and the substrate fixability was evaluated according to the following criteria:

AA: No changes were observed.
A: A slight decrease in density was observed but the overall image quality was satisfactory.
B: A small decrease in density was observed but the overall image quality was acceptable.
C: A significant decrease in density was observed.

Example 2

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the black ink described above except that the cyan pigment liquid dispersion was used instead of the black pigment liquid dispersion.

Yellow

A yellow ink was prepared as with preparation of the black ink described above except that the yellow pigment liquid dispersion was used instead of the black pigment liquid dispersion.

Example 3

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Magenta

A magenta ink was prepared as with preparation of the black ink described above except that the magenta pigment liquid dispersion was used instead of the black pigment liquid dispersion.

Cyan

| | |
|---|---|
| Cyan pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Yellow

A yellow ink was prepared as with preparation of the black ink described above except that the yellow pigment liquid dispersion was used instead of the black pigment liquid dispersion.

Example 4

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Magenta

A magenta ink was prepared as with preparation of the black ink described above except that the magenta pigment liquid dispersion was used instead of the black pigment liquid dispersion.

Cyan

A cyan ink was prepared as with preparation of the black ink described above except that the cyan pigment liquid dispersion was used instead of the black pigment liquid dispersion.

Yellow

| | |
|---|---|
| Yellow pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Example 5

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 3.5 parts by weight |
| 1,3-Butanediol (bp: 203° C.): | 24.5 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 6

An ink set was prepared as in Example 1 except that the inks were changed as follows. Evaluation was conducted as in Example 1.

Black

| | |
|---|---|
| Black pigment liquid dispersion prepared as above: | 40 parts by weight |

-continued

| | |
|---|---|
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 2 parts by weight |
| 1,3-Butanediol (bp: 203° C.): | 26 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 7

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 8 parts by weight |
| 1,3-Butanediol (bp: 203° C.): | 20 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 8

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 1 parts by weight |
| 1,3-Butanediol (bp: 203° C.): | 27 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 9

An ink set was prepared as in Example 1 except that the inks were changed as follows. Evaluation was conducted as in Example 1.

Black

| | |
|---|---|
| Black pigment liquid dispersion prepared as above: | 40 parts by weight |

-continued

| | |
|---|---|
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 13 parts by weight |
| 3-Methyl-1,3-butanediol (bp: 203° C.): | 10 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 10

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monovinyl ether (bp: 196° C.): | 14 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monovinyl ether (bp: 196° C.): | 28 parts by weight |
| Preservative fungicide (Proxel LV produced | 0.1 parts by weight |

-continued

| | |
|---|---|
| by Avecia Biocides): | |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 11

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Triethylene glycol dimethyl ether (bp: 216° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Triethylene glycol dimethyl ether (bp: 216° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 12

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 1,2-Butanediol (bp: 194° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,2-Butanediol (bp: 194° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion vas used instead of the magenta pigment liquid dispersion.

Example 13

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol diethyl ether (bp: 189° C.): | 5 parts by weight |
| 2,3-Butanediol (bp: 183° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol diethyl ether (bp: 189° C.): | 12 parts by weight |

-continued

| | |
|---|---|
| 2,3-Butanediol (bp: 183° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 14

An ink set was prepared as in Example 1 except that the inks were changed as follows. Evaluation as conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 2,3-Butanediol (bp: 183° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 2,3-Butanediol (bp: 183° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 15

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 7630A, solid content: 32%, Tg: 53° C., produced by BASF): | 5 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 16

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 20 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 7630A, solid content: 32%, Tg: 53° C., produced by BASF): | 20 parts by weight |
| Surfactant (Zonyl FS-300 produced by DuPont): | 2 parts by weight |
| Diethylene glycol monobutyl ether (bp: 230° C.): | 12 parts by weight |

-continued

| | |
|---|---|
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Example 17

The inks prepared as in Example 1 were used to form printed images on a nonporous medium, namely, a polyvinyl chloride film (polyvinyl chloride film with gray glue, LSPV1270GT produced by Sakurai Co., Ltd.), heated to 30° C. by a heater built in a sheet transport belt. Printing was conducted in a high-grade, high-image-quality mode such that two single-color solid images each 30×30 mm in size were printed next to each other and a total of six combinations of the single-color solid images, namely, black-magenta, black-cyan, black-yellow, magenta-cyan, magenta-yellow, and cyan-yellow, were printed. The printed images were then dried with hot air and evaluated.

Example 18

The inks prepared as in Example 1 were used to form printed images on a nonporous medium, namely, a polyvinyl chloride film (polyvinyl chloride film with gray glue, LSPV1270GT produced by Sakurai Co., Ltd.), heated to 80° C. by a heater built in a sheet transport belt. Printing was conducted in a high-grade, high-image-quality mode such that two single-color solid images each 30×30 mm in size were printed next to each other and a total of six combinations of the single-color solid images, namely, black-magenta, black-cyan, black-yellow, magenta-cyan, magenta-yellow, and cyan-yellow, were printed. The printed images were then dried with hot air and evaluated.

Example 19

The inks prepared as in Example 1 were used to form printed images on a nonporous medium, namely, a polyester film (LS gloss white PET, LSPETG 1270 produced by Sakurai Co., Ltd.) heated to 55° C. by a heater built in a sheet transport belt. Printing was conducted in a high-grade, high-image-quality mode such that two single-color solid images each 30×30 mm in size were printed next to each other and a total of six combinations of the single-color solid images, namely, black-magenta, black-cyan, black-yellow, magenta-cyan, magenta-yellow, and cyan-yellow, were printed. The printed images were then dried with hot air and evaluated.

Example 20

The inks prepared as in Example 1 were used to form printed images on a nonporous medium, namely, a polycarbonate film (Iupilon, General Purpose Grade Clear Sheet, NF-2000 produced by Mitsubishi Gas Chemical Company, Inc., thickness: 0.3 mm) heated to 55° C. by a heater built in a sheet transport belt. Printing was conducted in a high-grade, high-image-quality mode such that two single-color solid images each 30×30 mm in size were printed next to each other and a total of six combinations of the single-color solid images, namely, black-magenta, black-cyan, black-yellow, magenta-cyan, magenta-yellow, and cyan-yellow, were printed. The printed images were then dried with hot air and evaluated.

Example 21

The ink set of Example 21 was prepared in the same manner as in Example 1 except that the inks were changed to the following:

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Diethylene glycol monobutyl ether (bp: 230° C.): | 15 parts by weight |
| 1,3-Butanediol (bp: 203° C.): | 13 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 7630A, solid content: 46%, Tg: 53° C., produced by BASF): | 5 parts by weight |
| Surfactant (Zonyl FS-300 produced by DuPont): | 2 parts by weight |
| Diethylene glycol monobutyl ether (bp: 230° C.): | 20 parts by weight |
| 1,3-Butanediol (bp: 203° C.): | 8 parts by weight |
| Preservative fungicide (Proxel LV produced by Avecia Biocides): | 0.1 parts by weight |
| Ion exchange water: | 19.9 parts by weight |

Cyan

A cyan ink was prepared in the same manner as in magenta pigment liquid dispersion described above except that the cyan pigment liquid dispersion was used instead of the magenta pigment liquid dispersion.

Yellow

A yellow ink was prepared in the same manner as in magenta pigment liquid dispersion described above except that the yellow pigment liquid dispersion was used instead of the magenta pigment liquid dispersion.

Example 22

The ink set of Example 22 was prepared in the same manner as in Example 1 except that the inks were changed to the following:

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |

-continued

| | |
|---|---|
| Diethylene glycol monobutyl ether (bp: 230° C.): | 2 parts by weight |
| 2,3-Butanediol (bp: 183° C.): | 26 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Acrylic resin emulsion aqueous solution (JONCRYL 7630A, solid content: 46%, Tg: 53° C., produced by BASF): | 5 parts by weight |
| Surfactant (Zonyl FS-300 produced by DuPont): | 2 parts by weight |
| Diethylene glycol monobutyl ether (bp: 230° C.): | 5 parts by weight |
| 2,3-Butanediol (bp: 183° C.): | 23 parts by weight |
| Preservative fungicide (Proxel LV produced by Avecia Biocides): | 0.1 parts by weight |
| Ion exchange water: | 19.9 parts by weight |

Cyan

A cyan ink was prepared in the same manner as in magenta pigment liquid dispersion described above except that the cyan pigment liquid dispersion was used instead of the magenta pigment liquid dispersion.

Yellow

A yellow ink was prepared in the same manner as in magenta pigment liquid dispersion described above except that the yellow pigment liquid dispersion was used instead of the magenta pigment liquid dispersion.

Comparative Example 1

The inks prepared as in Example 1 were used to form printed images on a nonporous medium, namely, a polyvinyl chloride film (polyvinyl chloride film with gray glue, LSPV1270GT produced by Sakurai Co., Ltd.) at 23° C. without using a heater built in a sheet transport belt. Printing was conducted in a high-grade, high-image-quality mode such that two single-color solid images each 30×30 men in size were printed next to each other and a total of six combinations of the single-color solid images, namely, black-magenta, black-cyan, black-yellow, magenta-cyan, magenta-yellow, and cyan-yellow, were printed. The printed images were then dried with hot air and evaluated.

Comparative Example 2

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Surfactant (Zonyl FS-300 produced by DuPont): | 2 parts by weight |
| Diethylene glycol monobutyl ether (bp: 230° C.): | 5 parts by weight |
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Magenta

| | |
|---|---|
| Magenta pigment liquid dispersion prepared as above: | 40 parts by weight |
| Surfactant (Zonyl FS-300 produced by DuPont): | 2 parts by weight |
| Diethylene glycol monobutyl ether (bp: 230° C.): | 12 parts by weight |
| 1,3-Butanediol (bp: 203° C.): | 16 parts by weight |
| Preservative fungicide (Proxel LV produced by Avecia Biocides): | 0.1 parts by weight |
| Ion exchange water: | 19.9 parts by weight |

Cyan

A cyan ink was prepared as with preparation of the magenta ink described above except that the cyan pigment liquid dispersion was used instead of the magenta pigment liquid dispersion.

Yellow

A yellow ink was prepared as with preparation of the magenta ink described above except that the yellow pigment liquid dispersion was used instead of the magenta pigment liquid dispersion.

Comparative Example 3

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 5 parts by weight |
| Surfactant (Zonyl FS-300 produced by DuPont): | 2 parts by weight |
| Preservative fungicide (Proxel LV produced by Avecia Biocides): | 0.1 parts by weight |
| Ion exchange water: | 39.9 parts by weight |

Magenta

A magenta ink was prepared as with preparation of the black ink described above except that the magenta pigment liquid dispersion was used instead of the black pigment liquid dispersion.

Cyan

A cyan ink was prepared as with preparation of the black ink described above except that the cyan pigment liquid dispersion was used instead of the black pigment liquid dispersion.

Yellow

A yellow ink was prepared as with preparation of the black ink described above except that the yellow pigment liquid dispersion was used instead of the black pigment liquid dispersion.

Comparative Example 4

An ink set was prepared as in Example 1 except that the inks were changed as follows. Evaluation was conducted as in Example 1.

Black

| | |
|---|---|
| Black pigment liquid dispersion prepared as above: | 40 parts by weight |
| Acrylic resin emulsion aqueous solution (JONCRYL 390, solid content: 46%, Tg: −5° C., produced by BASF): | 20 parts by weight |
| Surfactant (Zonyl FS-300 produced by DuPont): | 2 parts by weight |
| Diethylene glycol monobutyl ether (bp: 230° C.): | 5 parts by weight |

-continued

| | |
|---|---|
| 1,3-Butanediol (bp: 203° C.): | 23 parts by weight |
| Preservative fungicide (Proxel LV produced by Avecia Biocides): | 0.1 parts by weight |
| Ion exchange water: | 19.9 parts by weight |

Magenta

A magenta ink was prepared as with preparation of the black ink described above except that the magenta pigment liquid dispersion was used instead of the black pigment liquid dispersion.

Cyan

A cyan ink was prepared as with preparation of the black ink described above except that the cyan pigment liquid dispersion was used instead of the black pigment liquid dispersion.

Yellow

A yellow ink was prepared as with preparation of the black ink described above except that the yellow pigment liquid dispersion was used instead of the black pigment liquid dispersion.

Comparative Example 5

The inks prepared as in Example 1 were used to form printed images on a nonporous medium, namely, a polyvinyl chloride film (polyvinyl chloride film with gray glue, LSPV1270GT produced by Sakurai Co., Ltd.) heated to 100° C. with a heater built in the sheet transport belt. Printing was conducted in a high-grade, high-image-quality mode such that two single-color solid images each 30×30 mm in size were printed next to each other and a total of six combinations of the single-color solid images, namely, black-magenta, black-cyan, black-yellow, magenta-cyan, magenta-yellow, and cyan-yellow, were printed. The printed images were then dried with hot air and evaluated.

Comparative Example 6

The inks prepared as in Example 1 were used to form printed images on a porous medium, namely, printer paper (My Paper produced by Ricoh Company, Ltd.), heated to 55° C. with a heater built in the sheet transport belt, Printing was conducted in a high-grade, high-image-quality mode such that two single-color solid images each 30×30 mm in size were printed next to each other and a total of six combinations of the single-color solid images, namely, black-magenta, black-cyan, black-yellow, magenta-cyan, magenta-yellow, and cyan-yellow, were printed. The printed images were then dried with hot air and evaluated.

The evaluation results are shown in Table below.

TABLE

| | Evaluation results | | | | | | | | | |
|---|---|---|---|---|---|---|---|---|---|---|
| | Minimum film-forming temperature (° C.) | | | | Difference in temperature | | Substrate heating temperature | Image | | |
| | Black | Magenta | Cyan | Yellow | (° C.) | Substrate | (° C.) | bleeding | Gloss | Fixability |
| Example 1 | 62 | 67.5 | 67.5 | 67.5 | 5.5° C. | PVC | 55° C. | AA | AA | A |
| Example 2 | 67.5 | 62 | 67.5 | 67.5 | 5.5° C. | PVC | 55° C. | A | A | A |
| Example 3 | 67.5 | 67.5 | 62 | 67.5 | 5.5° C. | PVC | 55° C. | A | A | A |
| Example 4 | 67.5 | 67.5 | 67.5 | 62 | 5.5° C. | PVC | 55° C. | A | A | A |
| Example 5 | 60.1 | 67.5 | 67.5 | 67.5 | 7.4° C. | PVC | 55° C. | AA | AA | A |
| Example 6 | 58.4 | 67.5 | 67.5 | 67.5 | 9.1° C. | PVC | 55° C. | AA | AA | A |
| Example 7 | 63.9 | 67.5 | 67.5 | 67.5 | 3.6° C. | PVC | 55° C. | A | A | A |
| Example 8 | 55.1 | 67.5 | 67.5 | 67.5 | 12.4° C. | PVC | 55° C. | AA | A | B |
| Example 9 | 62 | 67.5 | 67.5 | 67.5 | 5.5° C. | PVC | 55° C. | AA | AA | A |
| Example 10 | 45.8 | 53.4 | 53.4 | 53.4 | 7.6° C. | PVC | 55° C. | AA | A | A |
| Example 11 | 57.9 | 64.3 | 64.3 | 64.3 | 6.4° C. | PVC | 55° C. | AA | AA | A |
| Example 12 | 54.4 | 61.7 | 61.7 | 61.7 | 7.3° C. | PVC | 55° C. | AA | AA | A |
| Example 13 | 40.6 | 47.1 | 47.1 | 47.1 | 6.5° C. | PVC | 55° C. | AA | A | A |
| Example 14 | 53.1 | 60.3 | 60.3 | 60.3 | 7.2° C. | PVC | 55° C. | A | AA | A |
| Example 15 | 59 | 67.5 | 67.5 | 67.5 | 8.5° C. | PVC | 55° C. | AA | AA | A |
| Example 16 | 61 | 66.5 | 66.5 | 66.5 | 5.5° C. | PVC | 55° C. | AA | AA | AA |
| Example 17 | 62 | 67.5 | 67.5 | 67.5 | 5.5° C. | PVC | 30° C. | B | AA | A |
| Example 18 | 62 | 67.5 | 67.5 | 67.5 | 5.5° C. | PVC | 80° C. | AA | B | A |
| Example 19 | 62 | 67.5 | 67.5 | 67.5 | 5.5° C. | PET | 55° C. | AA | AA | A |
| Example 20 | 62 | 67.5 | 67.5 | 67.5 | 5.5° C. | Polycarbonate | 55° C. | AA | AA | A |
| Example 21 | 70.5 | 76 | 76 | 76 | 5.5° C. | PVC | 55° C. | AA | AA | A |
| Example 22 | 35.1 | 40.6 | 40.6 | 40.6 | 5.5° C. | PVC | 55° C. | AA | AA | A |
| Comparative Example 1 | 62 | 67.5 | 67.5 | 67.5 | 5.5° C. | PVC | 23° C. | C | C | C |
| Comparative Example 2 | No film was formed | No film was formed | No film was formed | No film was formed | — | PVC | 55° C. | C | C | C |
| Comparative Example 3 | 77 | 77 | 77 | 77 | 0° C. | PVC | 55° C. | C | C | C |
| Comparative Example 4 | 60.7 | 60.7 | 60.7 | 60.7 | 0° C. | PVC | 55° C. | C | C | A |
| Comparative Example 5 | 62 | 67.5 | 67.5 | 67.5 | 5.5° C. | PVC | 100° C. | AA | C | A |
| Comparative Example 6 | 62 | 67.5 | 67.5 | 67.5 | 5.5° C. | Paper | 55° C. | B | C | B |

The results show that high-gloss, high-resolution images free of bleeding can be formed on nonporous substrates by using water-based inks of two or more colors if an inkjet ink set used in such an image forming method includes at least one water-based ink containing at least a coloring material, an emulsion resin, water, and a water-soluble solvent and having a minimum film-forming temperature different from the rest of the water-based inks. Moreover, the inks can be strongly fixed to the substrates. Thus, a highly stable ink jet recording apparatus that does not cause nozzle clogging even when left unused for a long time can be obtained.

As shown above, according to the present invention, an image forming method is provided that uses an ink jet water-based ink set, with which high-gloss, high-resolution images free of bleeding can be printed on nonporous substrates while strongly fixing the inks onto the nonporous substrates. A stable ink jet recording apparatus that can strongly fix inks onto nonporous substrates and does not cause nozzle clogging even when left unused for a long time is also provided.

Having now fully described embodiments of the present invention, it will be apparent to one of ordinary skill in the art that many changes and modifications can be made thereto without departing from the spirit and scope of embodiments of the invention as set forth herein.

What is claimed is:

1. A method of forming an image comprising:

a step of heating a nonporous substrate to a temperature in a range of from 30° C. to 80° C.; and a step of forming an image on the nonporous substrate by applying water-based inks of at least two colors to the nonporous substrate employing an ink jet technique, wherein an ink set that includes water-based inks each comprising a coloring material, an emulsion resin, water, and a water-soluble solvent is used to apply the water-based inks of the at least two colors, wherein amongst the water-based inks in the ink set, at least one water-based ink has a minimum film-forming temperature different from those of water-based inks of other colors, and wherein the water-based ink having the lowest minimum film-forming temperature has a minimum film-forming temperature 5° C. to 10° C. lower than that of another ink of another color, amongst the water-based inks in the ink set.

2. The method of forming an image according to claim 1, wherein the at least two colors is at least four colors containing black, and wherein at least black water-based ink has the lowest minimum film-forming temperature of the water-based inks in the ink set.

3. The method of forming an image according to claim 1, wherein at least one of the water-based inks in the ink set comprises at least two water-soluble solvents.

4. The method of forming an image according to claim 3, wherein, of the at least two water-soluble solvents in the water-based ink, a water-soluble solvent having the highest boiling point has a boiling point 10° C. to 40° C. different from a boiling point of a water-soluble solvent having the lowest boiling point.

5. The method of forming an image according to claim 1, wherein the emulsion resin contained in at least one of the water-based inks in the ink set is different from the emulsion resins contained in the other water-based inks in the ink set.

6. The method of forming an image according to claim 1, wherein a weight ratio of the emulsion resin contained in at least one of the water-based inks of the ink set is larger than a weight ratio of the coloring material contained in the at least one water-based ink.

7. An ink jet recording apparatus comprising:

an ink set comprising water-based inks of two or more colors, each water-based ink comprising a coloring material, an emulsion resin, water, and a water-soluble solvent, at least one of the water-based inks having a minimum film-forming temperature different from those of the water-based inks of other colors;

a heating device to heat a nonporous substrate; and an application device to apply the water-based inks of the ink set onto the nonporous substrate to conduct recording, wherein the water-based ink having the lowest minimum film-forming temperature has a minimum film-forming temperature 5° C. to 10° C. lower than that of another ink of another color amongst the water-based inks in the ink set.

8. A method of forming an image comprising:

a step of heating a nonporous substrate to a temperature in a range of from 30° C. to 80° C.; and a step of forming an image on the nonporous substrate by applying water-based inks of at least two colors to the nonporous substrate employing an ink jet technique, wherein an ink set that includes water-based inks each comprising a coloring material, resin particles, water, and a water-soluble solvent is used to apply the water-based inks of the at least two colors, wherein amongst the water-based inks in the ink set, at least one water-based ink has a minimum film-forming temperature different from those of water-based inks of other colors, and wherein the water-based ink having the lowest minimum film-forming temperature has a minimum film-forming temperature 5° C. to 10° C. lower than that of another ink of another color, amongst the water-based inks in the ink set.

9. The method of forming an image according to claim 8, wherein the at least two colors is at least four colors containing black, wherein at least black water-based ink has the lowest minimum film-forming temperature of the water-based inks in the ink set.

10. The method of forming an image according to claim 8, wherein at least one of the water-based inks in the ink set comprises at least two water-soluble solvents.

11. The method of forming an image according to claim 10, wherein, of the at least two water-soluble solvents in the water-based ink, a water-soluble solvent having the highest boiling point has a boiling point 10° C. to 40° C. different from a boiling point of a water-soluble solvent having the lowest boiling point.

12. The method of forming an image according to claim 8, wherein the resin particles contained in at least one of the water-based inks in the ink set is different from the resin particles contained in the other water-based inks in the ink set.

13. The method of forming an image according to claim 8, wherein a weight ratio of the resin particles contained in at least one of the water-based inks of the ink set is larger than a weight ratio of the coloring material contained in the at least one water-based ink.

14. An ink jet recording apparatus comprising:

an ink set comprising water-based inks of two or more colors, each water-based ink comprising a coloring material, resin particles, water, and a water-soluble solvent, at least one of the water-based inks having a minimum film-forming temperature different from those of the water-based inks of other colors;

a heating device to heat a nonporous substrate; and an application device to apply the water-based inks of the ink set onto the nonporous substrate to conduct recording, wherein the water-based ink having the lowest minimum film-forming temperature has a minimum film-forming temperature 5° C. to 10° C. lower than that of another ink of another color, amongst the water-based inks in the ink set.

* * * * *